US009273459B2

(12) United States Patent
Abele

(10) Patent No.: US 9,273,459 B2
(45) Date of Patent: Mar. 1, 2016

(54) FOUNDATION ANCHOR FOR INDUSTRIAL-SCALE MACHINES

(71) Applicant: SIEMENS AKTIENGESELLSCHAFT, Munich (DE)

(72) Inventor: Michael Abele, Rosstal (DE)

(73) Assignee: SIEMENS AKTIENGESELLSCHAFT (DE)

( * ) Notice: Subject to any disclaimer, the term of this patent is extended or adjusted under 35 U.S.C. 154(b) by 0 days.

(21) Appl. No.: 14/400,590

(22) PCT Filed: Apr. 24, 2013

(86) PCT No.: PCT/EP2013/058421
§ 371 (c)(1),
(2) Date: Nov. 12, 2014

(87) PCT Pub. No.: WO2013/171040
PCT Pub. Date: Nov. 21, 2013

(65) Prior Publication Data

US 2015/0128513 A1 May 14, 2015

(30) Foreign Application Priority Data

May 15, 2012 (DE) ..... 10 2012 208 114

(51) Int. Cl.
*E04B 1/41* (2006.01)
*E02D 27/44* (2006.01)
*E02D 27/50* (2006.01)

(52) U.S. Cl.
CPC . *E04B 1/41* (2013.01); *E02D 27/44* (2013.01); *E02D 27/50* (2013.01)

(58) Field of Classification Search
CPC ... E04B 1/41; E04B 2001/2684; E02D 27/50; E02D 27/42; E02D 27/44
USPC ..... 52/294–298, 156, 166, 170; 405/229–231
See application file for complete search history.

(56) References Cited

U.S. PATENT DOCUMENTS 4,614,070 A * 9/1986 Idland ..... E04H 12/2253 52/295
4,716,696 A * 1/1988 Yacoboni ..... E02D 27/42 52/167.1
5,456,051 A * 10/1995 Queen ..... E04C 5/20 52/677

(Continued)

FOREIGN PATENT DOCUMENTS

AT 374531 B 5/1984
CN 201512809 U 6/2010

(Continued)

OTHER PUBLICATIONS

International Search Report on International Application No. PCT/EP2013/058421, mailed Sep. 24, 2013, 2 pages.

*Primary Examiner* — Brian Glessner
*Assistant Examiner* — Adam Barlow
(74) *Attorney, Agent, or Firm* — Schmeiser Olsen & Watts LLP

(57) ABSTRACT

A foundation anchor for forcefittingly anchoring an industrial-scale machine in a concrete foundation, comprising an anchor casing that has at least one lateral wall, and a plurality of anchor rods that are attached to the anchor casing, said anchor casing comprising a securing section for securing the industrial-scale machine by means of securing bolts, and the anchor rods being connected to the at least one lateral wall such that forces are introduced from the at least one wall into the plurality of anchor rods in a substantially linear manner along the longitudinal extension axis of said anchor rods is provided.

17 Claims, 5 Drawing Sheets

(56) References Cited

U.S. PATENT DOCUMENTS

| | | | | | |
|---|---|---|---|---|---|
| 5,666,774 | A * | 9/1997 | Commins | E04H 12/2253 | 248/188.4 |
| 5,678,382 | A * | 10/1997 | Naito | E02D 27/42 | 52/295 |
| 5,749,189 | A * | 5/1998 | Oberg | E01F 9/0186 | 248/548 |
| 7,124,550 | B1 * | 10/2006 | Deming | E04B 1/4157 | 52/127.2 |
| 8,572,905 | B1 * | 11/2013 | Driggers | E02D 27/12 | 52/169.13 |
| 2012/0304570 | A1 | 12/2012 | Braun | | |

FOREIGN PATENT DOCUMENTS

| | | | |
|---|---|---|---|
| CN | 201534977 | U | 7/2010 |
| CN | 202099880 | U | 1/2012 |
| CN | 202164620 | U | 3/2012 |
| DE | 4335485 | A1 | 4/1995 |
| DE | 102009016892 | A1 | 10/2010 |
| JP | S59185230 | A | 10/1984 |
| JP | S60102428 | A | 6/1985 |
| JP | H07113238 | A | 5/1995 |
| JP | H08246469 | A | 9/1996 |
| JP | H09165754 | A | 6/1997 |

* cited by examiner

FOUNDATION ANCHOR FOR INDUSTRIAL-SCALE MACHINES

CROSS-REFERENCE TO RELATED APPLICATIONS

This application claims priority to PCT Application No. PCT/EP2013/058421 having a filing date of Apr. 24, 2013, based off of DE 102012208114.3 having a filing date of May 15, 2012, the entire contents of which are hereby incorporated by reference.

FIELD OF TECHNOLOGY

The following relates to a foundation anchor for non-positively anchoring an industrial-scale machine in a concrete foundation comprising an anchor box having at least one side wall, and a number of anchor rods attached to the anchor box, wherein the anchor box has a fastening section for fastening the industrial-scale machine by means of fastening bolts.

BACKGROUND

The anchoring of industrial-scale machines in a concrete foundation which has been provided specifically for supporting and fastening the machine places high technical demands on the components responsible for distributing forces into the concrete foundation. The foundation anchor therefore needs to be able to ensure not only the appropriate distribution of force and securing during the normal operation of the machine but also sufficient fastening to ensure that the machine is anchored even in the event of malfunction. During such operation when there is a malfunction, owing to the unbalance forces occurring in the machine, malfunction-induced loads can be transmitted to the concrete foundation which are at least twice as great as the regular operating loads.

Industrial-scale machines should in the present case be understood in particular as machines in power plants. The following thus relates, for example, to foundation anchors of bearing housings on high-pressure turbines, medium-pressure turbines, and low-pressure turbines in a steam turbine power plant. However, for example individual machine parts can likewise require a corresponding anchoring, such as, for example, intercept valves of reheater tubes in industry-standard steam turbine power plants.

The industrial-scale machines are typically fastened in a fastening section of a foundation anchor by means of high-strength metal fastening bolts provided specifically for this purpose, so that a secure fastening to the concrete foundation can be achieved. The relevant fastening bolts can, for example, be screwed in a suitable fashion to a fastening nut which is surrounded by the foundation anchor. The load is transmitted to the foundation anchor in such a way that the forces occurring are distributed into the concrete foundation in a suitable fashion.

According to the internal prior devices known to the Applicant, to a steel construction is sometimes used for the foundation anchor, which initially distributes the forces which occur on the machine into two side plates manufactured from structural steel, wherein the two side plates are each connected to two welded-on crossbeams. The crossbeams are each rigidly connected to a number of suitably formed anchor rods so that the forces acting on the crossbeams can be distributed into the anchor rods. The anchor rods themselves are anchored non-positively in the concrete foundation so that the forces are directed into the concrete foundation.

However, it proves to be disadvantageous that the forces acting on the foundation anchor cannot be diverted into the concrete foundation without the forces being redirected. Because the side plates and crossbeams are connected at an angle, when forces are transmitted bending stresses occur in the area where the side plates and crossbeams are joined together which can be significantly increased. In particular in the event of operation when there is a malfunction, the forces acting on this joining area can exceed the strength of the connection, as a result of which an undesired failure, sometimes accompanied by serious consequences, can occur.

The technical proposal according to patent AT374531B attempts to overcome these disadvantages. This patent describes a device for anchoring supports in concrete foundations so that they are resistant tensile forces. The devices according to an embodiment of the invention has an anchor box for connection, for example, to a machine support and to the sides of which multiple connecting bars are welded. After the connecting bars have been embedded in a concrete foundation and when a load is applied to the device during operation, the forces which occur are diverted by the anchor box via the connecting bars along their axis of longitudinal extent into the concrete foundation. However, a disadvantage of this technical solution is that the devices need to be completely prefabricated before they are incorporated into the concrete foundation. The length and the weight of the connecting bars consequently entails a high degree of handling and transportation complexity. In addition, in order to ensure that forces are transmitted advantageously from the anchor box to the connecting bars, it is necessary to align the anchor box and connecting bars accurately. However, this alignment can only be achieved with great technical effort because two heavy and elongated components have to be welded together. Moreover, the high forces which need to be transmitted require the anchor box and connecting bars to be welded together very carefully, which cannot be performed on site when the device is being installed in a concrete foundation but typically needs to be carefully prefabricated in a factory.

There is therefore a technical need to propose an improved foundation anchor which is capable of overcoming the disadvantages as described above. In particular, it is intended for the proposed foundation anchor to be improved in terms of its manufacturing accuracy, ease of handling and ease of transportation. At the same time, it is intended that it is suitable for transmitting operating loads and malfunction-induced loads of an industrial-scale machine to a concrete foundation in a suitable fashion without there being any need to fear failure owing to excessive bending stresses.

Furthermore, it is intended for the foundation anchor to transmit forces as advantageously as possible into the concrete foundation, especially with the avoidance of secondary stresses.

It is likewise desirable to propose a foundation anchor which has an advantageous performance-to-weight ratio, i.e. it is intended that the ratio of failure-safe acceptable load to the total weight of the foundation anchor is advantageous. In addition, it is intended that the foundation anchor enables tolerances to be compensated when the industrial-scale machine is installed on the concrete foundation. It is intended in particular that this tolerance compensation allows both angular errors and positional errors to be compensated.

SUMMARY

An aspect relates to a foundation anchor for non-positively anchoring an industrial-scale machine in a concrete foundation, which comprises an anchor box having at least one side wall and a number of anchor rods attached to the anchor box, wherein the anchor box has a fastening section for fastening the industrial-scale machine by means of fastening bolts, wherein the anchor rods are connected to the at least one side wall in such a way that forces are distributed from the at least one wall into the number of anchor rods essentially linearly along the axis of longitudinal extent of the anchor rods, wherein the anchor rods are connected to the at least one side wall via anchor sockets.

A further aspect relates to a bond between such a foundation anchor for non-positively anchoring an industrial-scale machine and a concrete foundation in which the foundation anchor is embedded, wherein the foundation anchor is embedded in the concrete foundation in such a way that the anchor box is surrounded at least largely by concrete and the anchor rods are surrounded completely.

According to embodiments of the invention, the anchor rods are connected to the at least one side wall via anchor sockets. For example, the anchor rods can thus be screwed into the anchor sockets. By aligning and connecting the anchor rods and anchor sockets, the anchor rods can be advantageously aligned with respect to the anchor box after the anchor rods and anchor sockets have been connected. According to embodiments of the invention, it is thus possible to prefabricate the foundation anchor in a space-saving and accurate fashion without, for example, there being any need to connect the anchor rods to the anchor sockets immediately. It is thus possible, for example, for the anchor box with the anchor sockets according to this embodiment to be prefabricated in a factory, wherein the anchor rods are connected to the anchor sockets only during installation on site, i.e. during embedding in the concrete foundation on site. This improves both the ease of handling and the ease of transportation.

According to embodiments of the invention, the anchor rods of the foundation anchor are additionally connected to the at least one side wall in such a way that forces are distributed essentially within the plane of the side wall linearly in the direction of the longitudinal extent of the anchor rods. Accordingly, there is no need to divert forces before the force which is to be distributed into the concrete foundation can be transmitted from the anchor box into the anchor rods. The forces distributed into the anchor rods are essentially transmitted as compressive and tensile stresses, wherein disadvantageous bending stresses can be avoided.

Because the need for crossbeams, as are known for example from some embodiments of the prior art, is avoided, a reduced structural space and a lower total weight of the foundation anchor additionally result. This in turn allows an improved performance-to-weight ratio. Accordingly, it is also possible to distribute relatively higher loads into the concrete foundation over a smaller structural space.

Distributing force linearly and non-positively into the concrete foundation furthermore enables creep effects, which can occur as a result of load-free pretensioning of the foundation anchor, to be avoided. Because the concrete foundation is subject to an ageing process in the course of its existence, which is typically accompanied by a reduction in volume, this can also result in a reduction of pretensioning which the foundation anchor has in the concrete foundation when no load is applied. Such a pretensioning is, for example, provided when the anchor rods extend through the whole concrete foundation and are pretensioned against and screwed to the end opposite the anchor box with no load being applied.

According to embodiments of the invention, the bond between the foundation anchor and the concrete foundation is designed such that the anchor box is surrounded at least largely by concrete and the anchor rods completely. Because they are completely embedded in the concrete, the anchor rods which are ultimately responsible for distributing forces into the concrete foundation allow the loads which occur to be distributed non-positively. In addition, creep effects can be avoided because the anchor rods are not subject to any pretensioning.

The anchor box provided by embodiments of the invention has a fastening section for fastening the industrial-scale machine by means of fastening bolts. The fastening section is preferably provided in a receptacle of the anchor box. This receptacle can be arranged inside the anchor box and made accessible through suitable openings.

According to a first preferred embodiment of the foundation anchor, it is provided that the anchor rods are arranged on the anchor box symmetrically with respect to the load axis of the foundation anchor. By virtue of the symmetrical arrangement, the partial loads transmitted to the anchor rods can be distributed uniformly. Furthermore, such a symmetrical arrangement ensures that excess stresses in the foundation anchor are avoided, which results in a generally lower likelihood of failure.

According to a development of this aspect, the anchor sockets are welded to the at least one side wall in such a way that a line of connection, extending perpendicularly to the longitudinal extent of an anchor socket, extends through the weld seams of the anchor socket through the center of gravity of the anchor socket, in cross-section with respect to the longitudinal extent of the anchor socket. According to the embodiment, further supplementary stresses from local eccentricities can thus be avoided, which could cause forces to be distributed asymmetrically into the concrete foundation. Furthermore, because of such local eccentricities, there could also be a greater likelihood of the foundation anchor failing when very high loads are distributed.

According to a further embodiment of the foundation anchor, the at least one side wall has a recess for receiving an anchor rod or for receiving an anchor socket. By virtue of this recess, the plane within which force is distributed into an anchor rod can be adjusted in a suitable manner. If, for example, an anchor rod is inserted into a recess according to the embodiment in such a way that its axis of longitudinal extent coincides with the plane of the at least one side wall, it is possible for forces to be transmitted from the wall to the anchor rod in a particularly suitable manner. In particular, the occurrence of bending stresses in the foundation anchor can be reduced by providing suitably dimensioned recesses.

According to a further preferred embodiment, the anchor box comprises a head plate which is rigidly connected to the at least one side wall and allows the force distributed into the fastening section to be transmitted to the at least one side wall. Consequently, the force distributed into the fastening section can be transmitted initially to the head plate which distributes the forces which occur in a suitable manner to the at least one side wall. It is consequently also possible to distribute force advantageously to the at least one side wall.

According to a development of this aspect, the head plate is rigidly connected to the at least one side wall via at least one circumferential weld seam, in particular via a double circumferential weld seam. A circumferential weld seam hereby relates to a closed weld seam, for example a closed weld seam with a circular or rectangular form. For this purpose, the head plate is, for example, inserted into a suitably formed opening of the anchor box and connected to the at least one side wall of the anchor box by at least one circumferential weld seam. The forces acting on the head plate can thus be transmitted in a suitable manner to all areas of the at least one side wall so that the forces are distributed advantageously to the at least one side wall. The design of a double circumferential weld seam hereby ensures a particularly rigid connection of the head plate and the at least one side wall.

According to a further embodiment of the invention, the fastening section has a domed washer and a domed nut into which the fastening bolt can be screwed in order to fasten the industrial-scale machine. The fastening bolt of the industrial-scale machine is hereby typically guided through a free opening of the domed washer and screwed into a suitably dimensioned mating thread in the domed nut. The forces transmitted by the fastening bolt are transmitted to the domed nut and subsequently to the domed washer. The domed washer for its part transmits these forces in turn to the anchor box in which it is held. Because a domed nut with a separate domed washer is provided, an angular error can advantageously be compensated by the two parts being positioned, for example, against each other.

According to a development of this aspect, once a fastening bolt of the industrials-scale machine has been fastened in the fastening section, the domed nut is in pressure contact with the domed washer and this domed washer is in turn in pressure contact with the head plate. Forces are consequently initially transmitted to the domed nut, from the latter to the domed washer and from the latter in turn to the head plate. Once the fastening is complete, the domed washer in the anchor box hereby presses from inside against the head plate in such a way that the latter applies a tensile force, directed away from the concrete foundation, to the at least one side wall of the anchor box.

According to an embodiment that is a development of the invention, the domed nut has a raised centering section which engages in a depression in the domed washer in such a way that the two components can be positioned against each other at an angle with pressure contact. Consequently, even when the domed nut is positioned at an angle against the domed washer, pressure contact can be formed which ensures that force is transmitted from the domed nut to the domed washer. By virtue of the positioning at an angle, angular errors can, for example, be compensated which arise when, for example, the fastening bolt can be inserted into and fastened in the fastening section only at a predetermined angle. At the same time, angular tolerances which the fastening bolt in the industrial-scale machine has can thus also be compensated.

According to a particularly preferred embodiment of the invention, the domed washer and the domed nut are held by the anchor box and can be displaced against the at least one side wall of the anchor box perpendicularly to the latter, in particular can be displaced by at least 20 mm, preferably by at least 25 mm. According to the embodiment, both the domed washer and the domed nut, which are held in the anchor box, thus also have a certain play in order to be able to compensate a displacement error by a displacement perpendicularly to the at least one side wall. This displacement error can, according to the embodiment of the invention, be 20 mm or even 25 mm. Manufacturing tolerances, which the bolt arrangement on the industrial-scale machine has, can thus also be compensated.

According to the embodiment, the head plate can have an opening with a diameter which enables such a displacement of the fastening bolt of the industrial-scale machine. The diameter of the opening surrounded by the head plate must hereby, according to a predetermined displacement, be designed to be relatively greater than the diameter of the fastening bolt itself.

According to a further embodiment of the invention, it is provided that the anchor box has multiple side walls, in particular four side walls, which are welded to one another, in particular are connected to one another via welded fillet welds. According to an embodiment, the anchor box can consequently be manufactured from flat shaped panels which can be connected to one another in a welding process that is easy to carry out. According to the embodiment, the multiple side walls can also be manufactured from structural steel panels so that the manufacturing process can be carried out cost-effectively and using conventional industrial methods. Welding the multiple side walls by means of welded fillet welds, on the one hand, ensures a particularly rigid connection of the components and, on the other hand, locally formed eccentricities can in turn be avoided.

According to a further advantageous embodiment of the foundation anchor, the anchor rods have threaded ribs over at least part of their longitudinal extent, preferably over the entire length of their longitudinal extent. These threaded ribs enable, on the one hand, the anchor rods to be connected advantageously to anchor sockets, attached to the anchor box, which have a suitable mating thread. The two components can be connected simply by screwing them together. Furthermore, threaded ribs present advantageous projections on the surface of the anchor rods which form an advantageous anchor structure during embedding in the concrete foundation. The anchor rods are hereby embedded in the concrete in such a way that the concrete engages in the thread turns and the anchor rods are thus surrounded non-positively by the concrete foundation. The extent of the anchoring depth can be adjusted by selecting a suitable size for the thread turn.

According to a further embodiment of the invention, the anchor rods are manufactured from prestressing steel. Prestressing steel is particularly suitable for absorbing tensile forces, as can occur especially in the event of operation when there is a malfunction. According to the embodiment, the forces distributed into the concrete foundation via the foundation anchor in a fail-safe manner can thus be significantly greater in comparison to conventional structural steel.

According to a further embodiment of the present invention, the anchor rods have a length of at least 1500 mm, preferably of at least 2500 mm. This length is sufficient to be able to distribute even malfunction-induced loads into the concrete foundation sufficiently securely without there being any need to fear failure of the foundation anchor in the concrete foundation. In particular, operating loads such as, for example, the performance torque, axial tensile force, thermal expansion loads, pipeline loads or imbalance loads can thus be distributed sufficiently into the concrete foundation. Even malfunction-induced loads such as, for example, those which occur when a blade of a steam turbine breaks or during an earthquake can thus be distributed into the concrete foundation in a fail-safe manner.

According to a further embodiment of the invention, the anchor rods are in each case closed off at their ends by a closing plate at the side opposite the anchor box. The closing plate is in turn completely embedded in concrete in the concrete foundation, together with the anchor rods.

Owing to its geometric extent, it represents a further anchor resistance which the foundation anchor can use to counteract large tensile forces when the latter occur. The anchor rods can hereby in turn be screwed to a closing socket which serves to fasten the closing plates. According to the embodiment, a single closing plate can be welded in a suitable fashion to a closing socket which is then screwed onto the ends of the anchor rods. The closing plates according to the embodiment further also allow the lengths of the individual anchor rods to be adjusted in a suitable fashion relative to one another. Such adjustment is especially advantageous when the foundation anchor is inserted into the concrete foundation as it is thus possible to change the height and position of the anchor box in a suitable fashion.

According to a further embodiment of the invention, the foundation anchor additionally has a supporting element which interacts with the at least one side wall of the anchor box in such a way that it can support the foundation anchor against a baseplate arranged beneath the concrete foundation. The supporting element is typically designed as a rod which is arranged in direct contact with the at least one side wall of the anchor box in order to support it. The supporting element primarily enables the foundation anchor to be supported temporarily during embedding in the concrete foundation, in particular when the extent of the thickness of the concrete foundation is greater than the extent of the length of the anchor rods. Accordingly, when embedded in the concrete foundation, the foundation anchor can be supported against a baseplate in order to align it in a suitable fashion, although the anchor rods do not contact the baseplate.

According to a particularly preferred embodiment of the foundation anchor, the latter has a performance weight of at least 10 kN/kg, preferably of at least 13 kN/kg, and most particularly preferably of 15 kN/kg.

Consequently, even high loads can be distributed effectively into the concrete foundation when a foundation anchor has a relatively low weight.

At the same time, the saving in weight of the foundation anchor according to the embodiment enables a significant cost saving with respect to expenditure on materials.

According to a first preferred embodiment of the bond between the foundation anchor and the concrete foundation, it is provided that the foundation anchor is designed to absorb forces of at least 2000 kN and preferably of at least 2500 kN, and to distribute them into the concrete foundation, with no damage being incurred. Consequently, even malfunction-induced loads in large industrial-scale machines can be transmitted into the concrete foundation effectively and with no risk of failure. This ensures that such machines operate in a secure fashion in the event of malfunctions.

According to a further embodiment of the bond according to the invention, the gaps between the anchor box and the concrete foundation are filled with a low-shrinkage grout. It is ensured that the anchor box is surrounded on all sides non-positively with concrete by virtue of the low shrinkage. It is thus possible that even torques caused by an eccentric load are centered by a suitable horizontal force couple which acts on the concrete in each case at different heights of the anchor box. According to a development of this aspect, even the whole foundation anchor can be surrounded in the concrete foundation with a suitable low-shrinkage grout. PAGEL V1-50 may be mentioned as an example of such a material.

The embodiments of the invention are described in detail below with the aid of individual drawings. It should be pointed out here that the drawings should be understood as only being examples and do not limit the general nature of embodiments of the invention. It should also be pointed out that the dimensions of individual components are not always drawn to scale, as a result of which, however, there are in turn no limitations.

BRIEF DESCRIPTION

Some of the embodiments will be described in detail, with reference to the following figures, wherein like designations denote like members, wherein.

DETAILED DESCRIPTION

Figure 1:
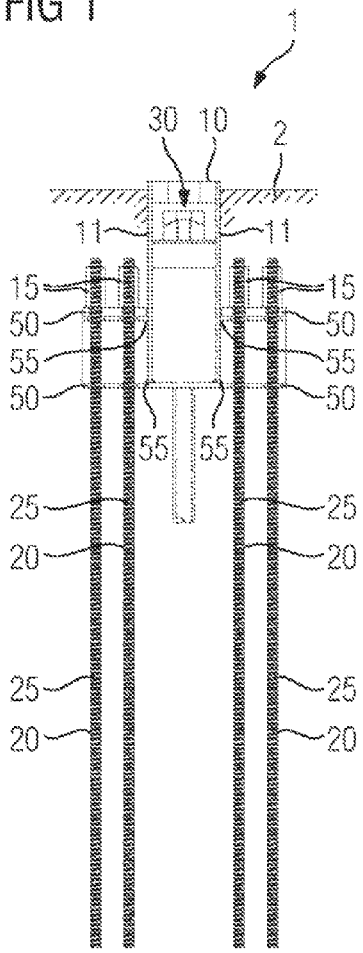
FIG. 1 shows a side view in section through a bond from the prior art between a foundation anchor and a concrete foundation.

FIG. 1 shows a side view in section through a bond between a foundation anchor 1, as known, and a concrete foundation 2. The foundation anchor 1 comprises an anchor box 10 which is largely embedded, together with eight anchor rods 20, in the concrete foundation 2. The anchor box 10 has two side walls 11 which are in each case connected to two crossbeams 50. The side wall 11 is connected to the crossbeam 50 in each case in a joining area 55. The side wall 11 is hereby welded to a crossbeam 50 with a right-angled arrangement being formed.

In order to fasten a fastening bolt 110 (not shown in further detail) of an industrial-scale machine 100 (not shown) in the foundation anchor 1, the latter has a fastening section 30 which is surrounded by the side walls 11.

In order to anchor the foundation anchor 1 in the concrete foundation 2, in all eight anchor rods 20 are provided which have suitable threaded ribs 25. The anchor rods 20 are screwed into suitable anchor sockets 15 in order to fasten the anchor rods 20 to the anchor box 10. The anchor sockets 15 are hereby each rigidly connected to a crossbeam 50 so that forces distributed into the anchor box 10 result in forces being distributed into the anchor rods 20 after being diverted into the crossbeams 50. However, because forces are diverted in this way, excessive stress can occur in particular in the region of the joining area 55, which can cause the whole foundation anchor 1 to fail when subjected to a high load. The present embodiment of the invention attempts to overcome this weakness advantageously by virtue of the chosen arrangement.

Figure 2:
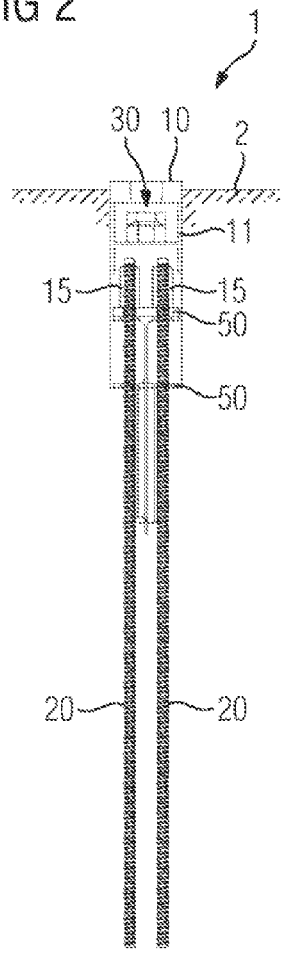
FIG. 2 shows a further side view in section through the bond shown in FIG. 1, in a side view rotated by 90° in comparison to the view shown in FIG. 1.

FIG. 2 shows a side view in section, rotated by 90°, through the foundation anchor 1 shown in FIG. 1. It can be seen that the forces distributed into the anchor box 10 can only be distributed into the concrete foundation on two sides on facing sides. In particular, only two side walls 11 are connected to in each case two crossbeams 50. However, the other two side walls 11 are not connected to the crossbeams 50, as a result of which forces are transmitted asymmetrically into the concrete foundation 2 in particular when forces are distributed eccentrically into the anchor box 10.

Figure 3:
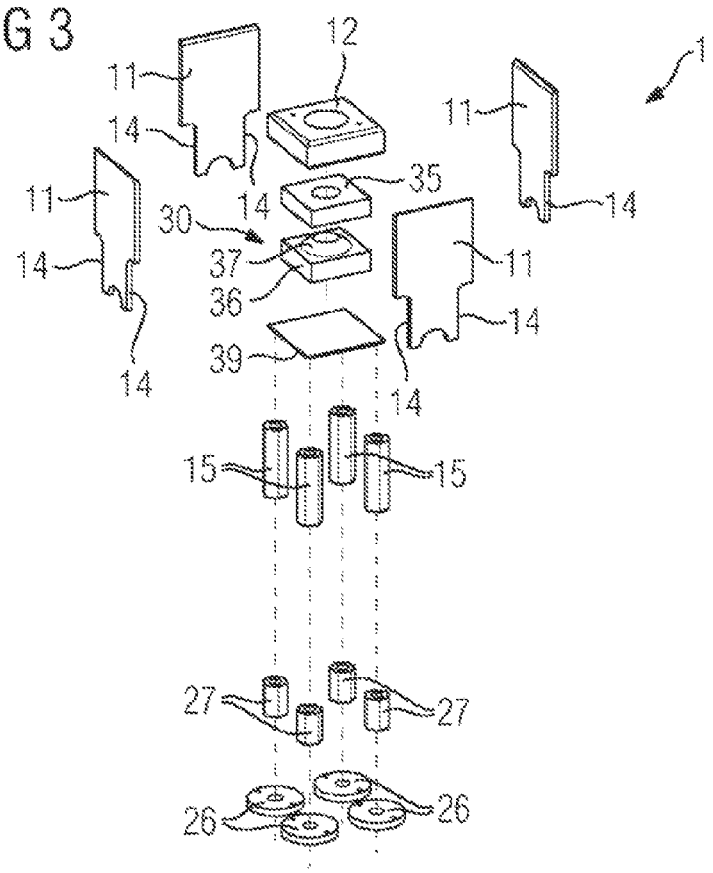
FIG. 3 shows a schematic exploded view of different constituent parts of a foundation anchor according to an embodiment of the present invention.

FIG. 3 shows an exploded view of different components of an embodiment of the foundation anchor 1 according to the embodiment of the invention. The anchor rods 20 are, however, not shown hereby. The foundation anchor 1 according to the embodiment comprises four side walls 11 which are each joined to an anchor box 10 at right angles to each other. The anchor box 10 is closed off at the end by a head plate 12 and on the opposite side by a baseplate 39. A domed washer 35 and a domed nut 36 are held in the spatial section defined by the joined side walls 11, the head plate 12 and the baseplate 39. Both the domed washer 35 and the domed nut 36 have a suitable opening, wherein a fastening bolt (not shown) of an industrial-scale machine can be fastened in the domed nut 36. The bolt is hereby to be passed through the opening provided in the head plate 12 and screwed to the domed nut 36.

The embodiment shown of the foundation anchor 1 comprises four anchor sockets 15 which have a hexagonal outer cross-section. The anchor sockets 15 can be inserted in a suitable fashion into the recesses 14 provided in the side walls 11 so that a spatial indentation toward the centrally arranged load axis of the system is achieved. According to the embodiment, the anchor sockets 15 are each welded to a respective side wall 11 by a weld seam.

The foundation anchor 1 according to the embodiment of the invention further comprises four end sockets 27 which can be screwed to the ends of the anchor rods 20 on the side of the latter opposite the anchor box 10.

The foundation anchor 1 additionally has four closing plates 26 which likewise close off the ends of the anchor rods 20. According to the embodiment, the end sockets 27 are welded in each case to a closing plate 26 and screwed to the end of the anchor rod 20 opposite the anchor box 10.

The fastening section 30 surrounded by the anchor box 10 comprises the domed washer 35 with the domed nut 36. The domed nut 36 has a conical or partially spherical centering section 37 which engages in a depression 38 (not shown in further detail) in the domed washer 35, wherein the two components can be placed against each other at an angle. When the domed nut 36 is placed at an angle against the domed washer 35, pressure contact is formed between the surface of the centering section 37 and the surface of the depression 38 which ensures that forces are distributed non-positively in a suitable fashion. When a fastening bolt is screwed completely into the domed nut 36, that face of the domed washer 35 which faces the head plate 12 presses against the head plate 12. Non-positive distribution of forces is thereby likewise ensured.

Figure 4:
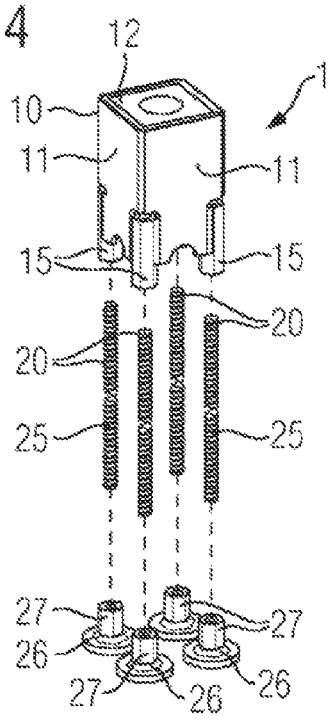
FIG. 4 shows a partially exploded view of the embodiment shown in FIG. 3 of the foundation anchor according to the embodiment of the invention.

As illustrated in FIG. 4, the side walls 11 shown in FIG. 3 are connected to the head plate 12 by a circumferential weld seam. In particular, the side walls 11 are connected to the head plate 12 by two circumferential weld seams. At the same time, the side walls 11 are each welded to one another in the region of the mutually contacting edge areas.

Figure 5:
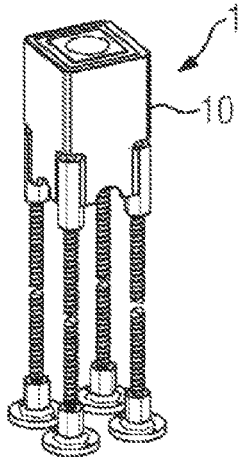
FIG. 5 shows a perspective side view of the embodiment shown in FIG. 3 and FIG. 4 of the foundation anchor according to the embodiment of the invention after all the components have been connected in accordance with the intended use.

FIG. 5 shows the embodiment of the foundation anchor 1 according to the embodiment of the invention shown in FIGS. 3 and 4 after all the components have been assembled in accordance with the intended use. The anchor rods 20 surrounded by the foundation anchor 1 have suitable threaded ribs 25 which can be screwed to matching counter threads in the anchor sockets 15 and the end sockets 27. The screwing together enables the anchor box 10 to be connected to the anchor rods 20 and consequently the individual parts to be handled appropriately during assembly. It is thus in particular advantageous to screw the anchor rods 20 to the anchor box 10 and the end sockets 27 only at the site where it is to be deployed. Furthermore, on this occasion it is also possible to adjust the length of the individual anchor rods in a suitable fashion relative to one another.

Figure 6:
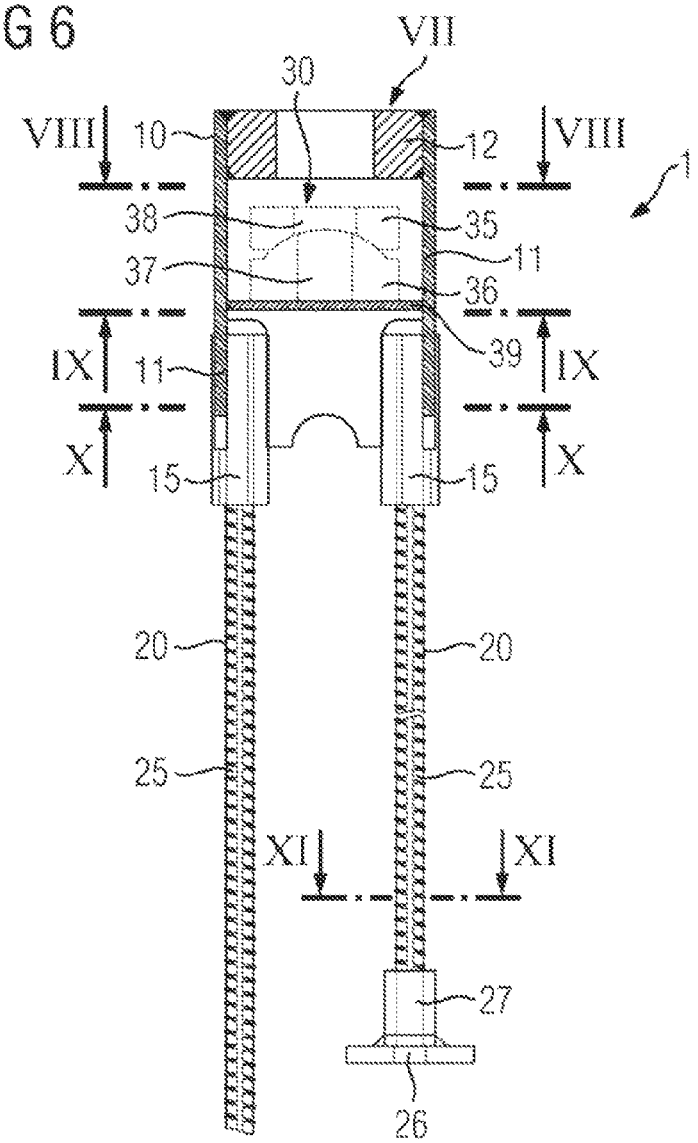
FIG. 6 shows a side view in section through a further embodiment of a bond between the foundation anchor according to the embodiment of the invention and a concrete foundation.

FIG. 6 shows a side view in section through a further embodiment of the foundation anchor 1 according to the embodiment of the invention in a state where it is already embedded in a concrete foundation 2.

The anchor box 10 is hereby almost completely embedded in the concrete foundation 2. There is only a slight protrusion of the anchor box 10 projecting from the surface of the concrete foundation 2. The protrusion is arranged in the region of the head plate 12 which has a circular opening. According to the view illustrated, below this are then arranged a domed washer 35 and a domed nut 36. The domed nut 36 is supported against the baseplate 39. In order to fasten a fastening bolt 10 (not shown in greater detail) of an industrial-scale machine 100 (not shown), the fastening bolt 110 is passed through the opening in the head plate 12 and is screwed to the thread of the domed nut 36. The fastening bolt 110 hereby likewise projects through a suitable opening of the domed washer 35. The opening of the domed washer 35 has a slightly larger diameter than the thread diameter of the domed nut 36. In order to compensate an angular displacement, the domed nut 36 can be placed at an angle against the domed washer 35, wherein the surface of the partially spherically formed centering section 37 presses against the surface of the correspondingly adjusted depression 38 of the domed washer 35.

When a fastening bolt 110 is fastened in the domed nut 36, with pressure being transmitted, the pressure is transmitted from the domed nut 36 to the domed washer 35 and then to the head plate 12. Because the head plate 12 is fastened to the side walls 11, force is transmitted into the side walls 11 which, in the present view, is continued perpendicularly downward to the anchor rods 20.

In order to be able to compensate a horizontal displacement, the domed nut 36 and the domed washer 35 are displaceably arranged in the anchor box 10. At the same time, the opening in the head plate 12 has a sufficiently large diameter so that a bolt penetrating the head plate 12 is not prevented from being displaced. The size of the opening in the head plate 12 can determine the maximum lateral displacement.

The anchor sockets 15 attached to the anchor box 10 are, according to the embodiment, inserted into recesses 14, as a result of which an offset toward the load axis L is achieved. It is consequently also possible to adjust the alignment of the side walls 11 with the longitudinal extent of the anchor rods 20 in a suitable fashion. According to the present embodiment, the anchor rods 20 are arranged essentially parallel to the faces of the side walls 11. Furthermore, a slight offset of the direction of the longitudinal extent of the anchor rods 20 is provided with respect to the planes of the side walls 11.

According to the embodiment, this offset can be essentially zero. By virtue of this arrangement, the forces transmitted through the side walls 11 can be distributed essentially linearly, without the formation of bending stresses, into the anchor sockets 15 and then into the anchor rods 20. For anchoring in the concrete foundation 2, the anchor rods 20 have suitably formed threaded ribs 25 into the threads of which the concrete of the concrete foundation 2 engages.

Figure 7:
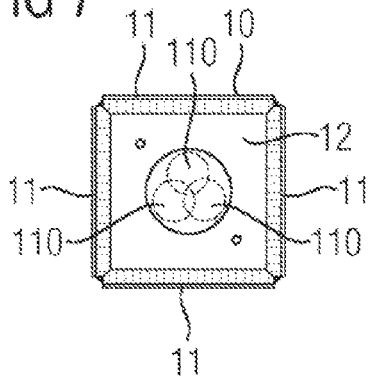
FIG. 7 shows a first view in section according to a section through the plane A-A of the embodiment of the foundation anchor shown in FIG. 6.

FIG. 7 shows a first view in section along the plane of section A-A through the embodiment, shown in FIG. 6, of the foundation anchor 1. The view in section shows a view from above of the head plate 12 which is inserted into the recess defined by the four side walls 11 and is fastened by a circumferential weld seam. The opening included in the head plate 12 has a diameter which is larger than the diameter of a fastening bolt 110 of an industrial-scale machine 100 (not shown in the present case). Because of this difference in size, a lateral displacement of the fastening bolt 110 can be allowed in order to compensate tolerances caused by the manufacturing process.

Figure 8:
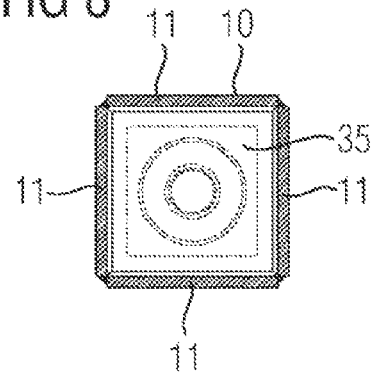
FIG. 8 shows a second view in section according to a section through the plane B-B of the embodiment of the foundation anchor shown in FIG. 6.

FIG. 8 shows a second view in section along the plane of section B-B through the embodiment, shown in FIG. 6, of the foundation anchor 1. The view in section represents the anchor box 10 and shows a view from above of the domed washer 35. The view makes clear the lateral spacing of the domed washer 35 from the side walls 11, which allows lateral displacement within the surface shown.

Figure 9:
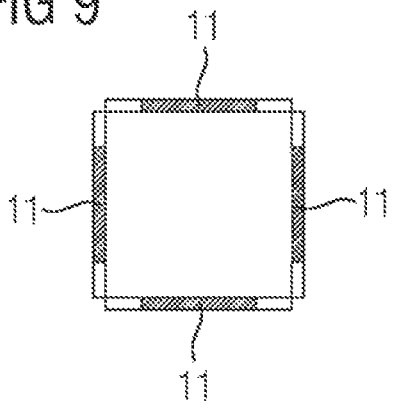
FIG. 9 shows a third view in section according to a section through the plane C-C of the embodiment of the foundation anchor shown in FIG. 6.

FIG. 9 shows a further view in section along the plane of section C-C of the foundation anchor 1 shown in FIG. 6. The section is hereby through the sections lying between the baseplate 39 and the anchor sockets 15.

Figure 10:
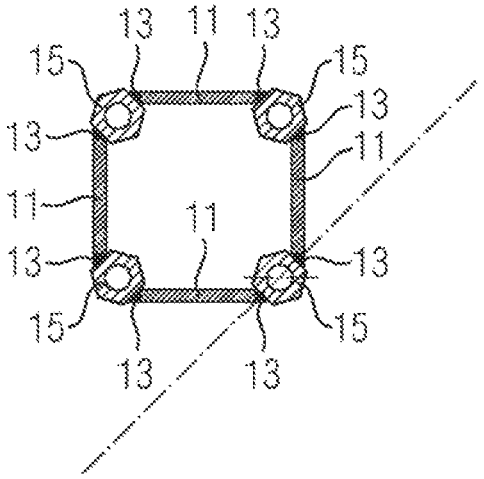
FIG. 10 shows a fourth view in section according to a section through the plane D-D of the embodiment of the foundation anchor shown in FIG. 6.

FIG. 10 shows a further view in section through the foundation anchor 1 shown in FIG. 6 along the plane of section D-D. The plane of section passes perpendicularly through the anchor sockets 15 which are each welded to the side walls 11. The welding is effected by means of two weld seams 13 in each case which connect the side edge areas of the side walls 11 to the outwardly directed surfaces of the anchor sockets 15. According to the embodiment, the welding is performed in such a way that a connecting line through the weld seams of the anchor socket 15, running perpendicularly to the longitudinal extent of an anchor socket, runs through the center of gravity of the anchor socket 15 in a cross-section through the longitudinal extent of the anchor socket 15.

Figure 11:
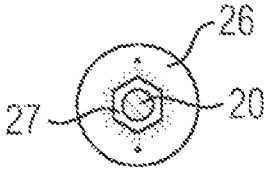
FIG. 11 shows a fifth view in section according to a section through the plane E-E of the embodiment of the foundation anchor shown in FIG. 6.

FIG. 11 shows a further view in section through the embodiments shown in FIG. 6 of the foundation anchor 1. The section hereby shows a view from above of the end socket 27, screwed onto the end of an anchor rod 20, which is welded to a closing plate 26.

Figure 12:
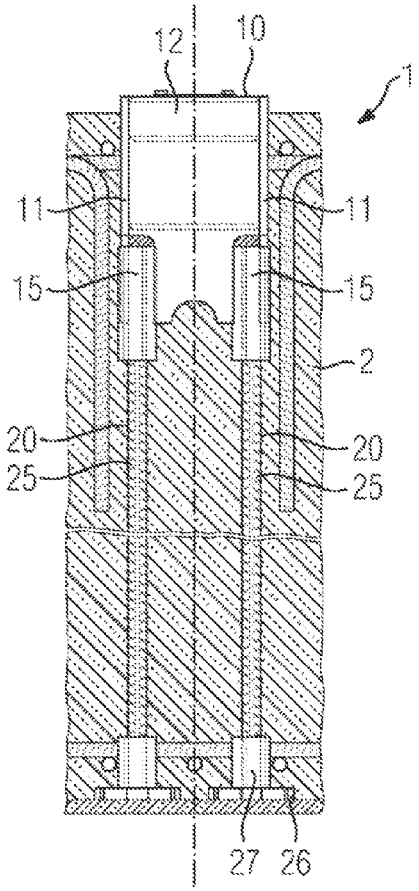
FIG. 12 shows a further side view in section through an embodiment of the bond between the foundation anchor according to the embodiment of the invention and a concrete foundation.

FIG. 12 shows a further embodiment of a bond according to the embodiment of the invention between a foundation anchor 1 and a concrete foundation 2. The foundation anchor 1 hereby essentially has no structural differences from the embodiment of the foundation anchor 1 shown in FIGS. 6 to 11. It can, however, be clearly seen that the foundation anchor 1 is embedded in the concrete foundation 2 in such a way that the closing plates 26 provided on the anchor rods 20 are in each case aligned with each other at the same level. This alignment allows advantageous horizontal alignment when the foundation anchor 1 is inserted into the concrete foundation 2.

Figure 13:
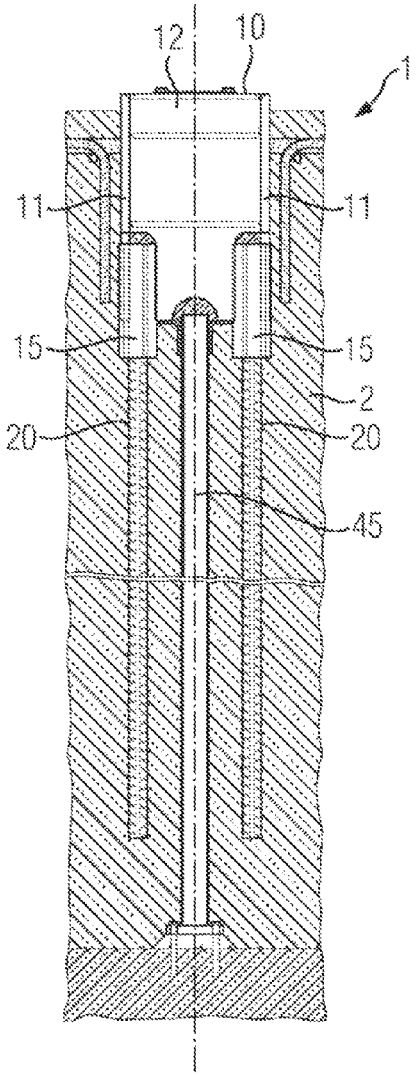
FIG. 13 shows a further side view in section through an embodiment of the bond between the foundation anchor according to the embodiment of the invention and a concrete foundation with a supporting element.

FIG. 13 shows a further embodiment of the foundation anchor 1 according to the embodiment of the invention which is embedded in a concrete foundation 2. In contrast to the embodiment shown in FIG. 12, the embodiment shown in FIG. 13 has a support element 45 which can be provided, for example, in the case of high concrete foundations in which the anchor rods 20 are shorter than the thickness of the foundation. The support element 45 takes the form of a rod and is in contact with the at least one side wall 11 for support purposes. On that side of the support element 45 opposite the anchor box 10, the anchor box 10 is in direct contact with a baseplate.

Other embodiments follow from the subclaims.

The invention claimed is:

1. A foundation anchor for anchoring an industrial-scale machine in a concrete foundation comprising: an anchor box having at least two side walls, and a number of anchor rods attached to the anchor box, wherein the anchor box has a fastening section for fastening the industrial-scale machine by means of fastening bolts, wherein the anchor rods are connected to the at least two side walls in such a way that forces are distributed from the at least two side walls into the number of anchor rods essentially linearly along the axis of longitudinal extent of the at least one of the number of anchor rods, wherein the at least one of the number of anchor rods is connected to the at least two side walls via at least one anchor socket, and wherein the anchor socket is welded to the at least two side walls in such a way that a connecting line through weld seams of at least one of the number of anchor rods, running perpendicularly to the longitudinal extent of an anchor socket, runs through the center of gravity of the anchor socket in a cross-section through the longitudinal extent of the anchor socket.

2. The foundation anchor as claimed in claim 1, wherein the anchor rods are arranged on the anchor box symmetrically with respect to the load axis of the foundation anchor.

3. The foundation anchor as claimed in claim 1, wherein the at least two side walls have a recesses for receiving an anchor rod or for receiving an anchor socket.

4. The foundation anchor as claimed in claim 3, wherein the anchor socket is inserted into the recess of the side wall in such a way that a spatial indentation toward the centrally arranged load axis of the foundation anchor is achieved.

5. The foundation anchor as claimed in claim 1, wherein the anchor box comprises a head plate which is rigidly connected to the at least two side walls and allows the force distributed into the fastening section to be transmitted to the at least two side walls.

6. The foundation anchor as claimed in claim 1, wherein the fastening section has a domed washer and a domed nut into which the fastening bolt are screwed in order to fasten the industrial-scale machine.

7. The foundation anchor as claimed in claim 6, wherein the domed nut has a raised centering section which engages in a depression in the domed washer in such a way that the two components are positioned against each other at an angle with pressure contact.

8. The foundation anchor as claimed in claim 6, wherein the domed washer and the domed nut are held by the anchor box and are displaced against the at least two side walls perpendicularly to the anchor box by at least 20 mm.

9. The foundation anchor as claimed in claim 1, wherein the anchor rods have threaded ribs over at least part of their longitudinal extent.

10. The foundation anchor as claimed in claim 1, wherein the anchor rods are in each case closed off at their ends by a closing plate at the side opposite the anchor box.

11. The foundation anchor as claimed claim 1, wherein the foundation anchor has a performance weight of at least 10 kN/kg.

12. A bond between a foundation anchor for anchoring an industrial-scale machine as claimed in claim 1 and a concrete foundation in which the foundation anchor is embedded, wherein the foundation anchor is embedded in the concrete foundation in such a way that the anchor box is surrounded at least largely by concrete and the anchor rods are surrounded completely.

13. The bond as claimed in claim 12, wherein the foundation anchor is designed to absorb forces of at least 2000 kN, and to distribute them into the concrete foundation, with no damage being incurred.

14. The bond as claimed in claim 12, wherein gaps between the anchor box and the concrete foundation are filled with a low-shrinkage grout.

15. The foundation anchor as claimed in claim 9 wherein the domed washer and the domed nut are held by the anchor box and are displaced against the at least two side walls perpendicularly to the anchor box by at least 25 mm.

16. The foundation anchor as claim 1, wherein the foundation anchor has a performance weight of at least 13 kN/kg.

17. The bond as claimed in claim 12, wherein the foundation anchor is designed to absorb forces of at least 2500 kN, and to distribute them into the concrete foundation, with no damage being incurred.

* * * * *